United States Patent [19]

George

[11] Patent Number: 4,575,300

[45] Date of Patent: Mar. 11, 1986

[54] CONTAINER LIFT APPARATUS FOR A GARBAGE TRUCK

[76] Inventor: Richard D. George, P.O. Box 1464, Conrad, Mont. 59425

[21] Appl. No.: 620,483

[22] Filed: Jun. 14, 1984

[51] Int. Cl.[4] ..... B65F 3/04

[52] U.S. Cl. ..... 414/406; 414/420; 414/421; 414/501; 414/556

[58] Field of Search ..... 414/406, 408, 409, 501, 414/546, 552, 555, 556, 420, 421

[56] References Cited

U.S. PATENT DOCUMENTS 3,762,586 10/1973 Updike ..... 414/408

OTHER PUBLICATIONS

Brochure, "Lam by LoDal", L-77, LoDal, Inc., Kingsford, Michigan.

Brochure, "EMCO RC-30 Body", Ebeling Manufacturing Corporation, d/b/a EMCO, P.O. Drawer 1210, Plainview, Texas 79072.

Advertisement, *Waste Age,* Jan. 1984, by Pak-More Manufacturing Company, 1123 S.E. Military Drive, P.O. Box 14147, San Antonio, TX.

Ad, "Refuse Collection System", Neufeldt Industries Ltd., Box 597, Lethbridge, Alberta, Canada T1J 3Z4.

Ad, *Waste Age,* May 1983, by The Heil Company, P.O. Box 8687, Chattanooga, TN 37411.

Ad, *Waste Age,* May 1983, by LoDal, Inc.

*Primary Examiner*—Robert G. Sheridan

*Attorney, Agent, or Firm*—Merchant, Gould, Smith, Edell, Welter & Schmidt

[57] ABSTRACT

The present invention is directed to container lift apparatus for a side loading garbage truck. The apparatus includes mechanism for lifting and rotating a container to dump the garbage therein in the open side hopper of the truck. Also, upper and lower retaining assemblies provide for shocking the garbage container during its rotation so that the garbage may be jarred loose from the container. Stabilizing legs support the side hopper to prevent the truck from tipping during the lifting and dumping of the container.

12 Claims, 6 Drawing Figures

FIG. 1
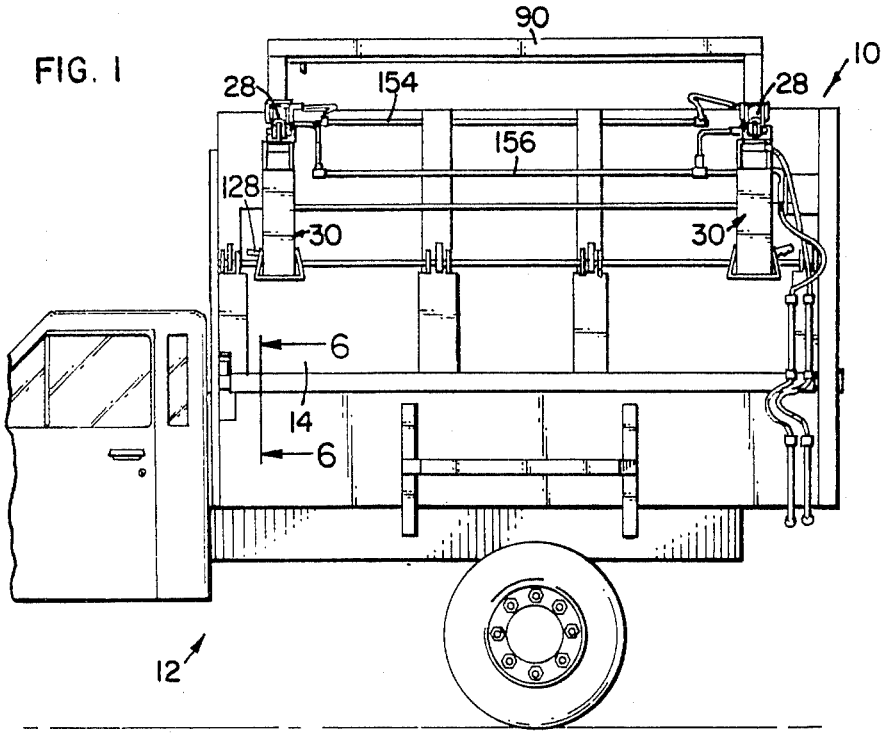
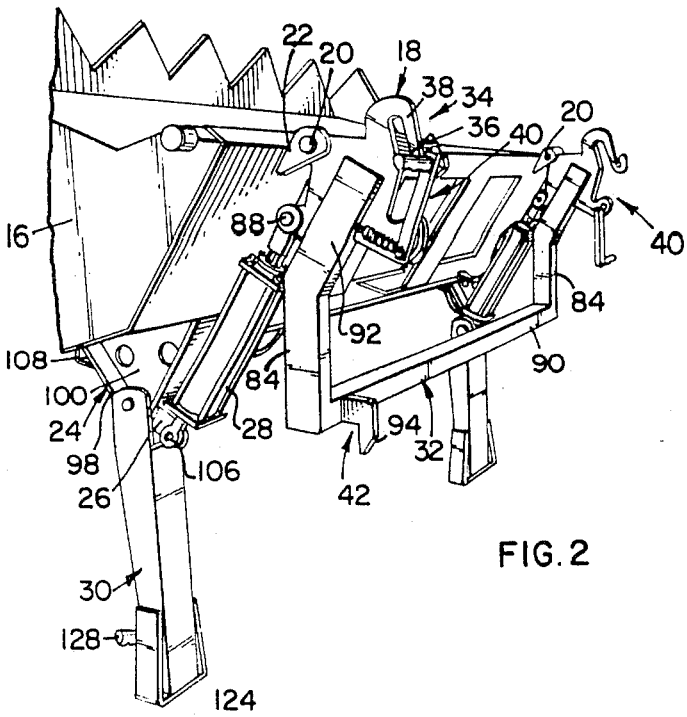
FIG. 2

CONTAINER LIFT APPARATUS FOR A GARBAGE TRUCK

FIELD OF THE INVENTION

The present invention is directed to the field of garbage trucks and, more particularly, to apparatus for lifting garbage containers and dumping them into the hopper of a side-loading garbage truck.

BACKGROUND OF THE INVENTION

Not too many years ago, people burned garbage in open containers in their backyards. Pollution laws, however, in recent years have virtually outlawed such practice throughout the nation. As a result, most garbage today is picked up and hauled to central landfills or other disposal sites.

A variety of garbage truck designs are presently known in the garbage collection industry. Such trucks include front loading, back loading and side loading types. The front loading type include mechanism for lifting a container over the cab before dumping it into the box behind the cab. Back loading types usually have a trough at the back of the box for receiving garbage. The garbage is usually manually lifted into the trough or deposited therein with a loader. In any case, the back loading type usually have a wall for moving the garbage out of the trough and compressing it forwardly into the box.

The present invention is directed to side loading garbage trucks. A number of designs are known. For example, one design allows a person to mount a step and deposit a can of garbage in a trough between the cab and box of the truck. A conveying mechanism then moves the garbage from the trough into the box. Another design has a single arm mechanism between the box and the cab which extends to grab a round container and lift it to the top of the box for deposit of the garbage therein. Still another design uses a pair of arms pivoted near the top of the box and located along the side of the truck to grab opposite sides of a container and lift the container straight upwardly and then over the box to deposit garbage therein.

Most relevant to the present invention is a truck and container system wherein the side of the box of the truck powers down and becomes a hopper into which garbage may be dumped. On pivoting the side upwardly, the garbage is moved into the box. Although garbage may be manually lifted and deposited in the side hopper, the truck is usually used in combination with a container which has its own hydraulic lift mechanism for lifting the container from a base, rotating the container and dumping the garbage contents into the side hopper of the truck. Energization for the hydraulic system comes from a make and break connection between the container hydraulic assembly and the hydraulic system of the truck. Although the system is workable, it is expensive. Each container must have its own hydraulic lift assembly. Furthermore, use of the system requires proper positioning of the truck so that when the side is powered down, it is located properly to receive garbage from the container after it is lifted and rotated for dumping. Also, the operator must take the time to connect the hydraulic lift assembly of the container to the hydraulic system of the truck for each container encountered.

The present invention eliminates the need for separate lift assembles for each container by disclosing an appropriate lift assembly for attachment to a side hopper of the truck.

SUMMARY OF THE INVENTION

The present invention is directed to container lift apparatus for a garbage truck wherein the truck has a box and mechanism for pivoting a side of the box between open and closed positions. The box side in the open position forms a hopper for receiving garbage. The side is movable with the pivoting mechanism to the closed position thereby moving the garbage from the hopper to the box. The container lift apparatus includes an arm and mechanism for pivotably attaching the arm to the hopper. The container lift apparatus also includes an hydraulic piston and cylinder assembly having one end attached to the hopper and a second end attached to the arm at a location spaced from the axis of the arm attaching mechanism. The apparatus further includes mechanism for controllably energizing the hydraulic piston and cylinder assembly. In addition, the container lift apparatus has mechanism, attached to the arm, for holding the container whereby such mechanism holds the container as the hydraulic assembly rotates the arm to lift the container and dump garbage from the container into the hopper.

In another embodiment, the container lift apparatus includes a pair of spaced apart arms. The arms are pivotably attached to the hopper. A pair of hydraulic piston and cylinder assemblies each has one end attached to the hopper and a second end attached to one of the arms. The assemblies function to powerably rotate the arms. A pair of legs rotate downwardly from a stored position next to the hopper to provide stabilizing structure to prevent the truck from tipping when a particularly heavy garbage container is lifted.

Each arm includes a wide-angled, V-shaped slot. The slots in the arms are approximately equally spaced from the rotational axis of the arms and are, thus, aligned with one another with respect to the rotational axis. The slots have closable lock assemblies for opening to receive rods attached to a garbage container. The lock assemblies close and lock to hold the rods of the container in the slots. A strong back structure including a pair of downwardly extending legs attached to the arms and a cross member extending between the legs rotates with the arms to form a lift structure for the garbage container. A hook member is attached to the cross member and functions to catch a protuberance attached to the container when the container slides as it is rotated during lifting so that the rods attached to the container move from one end of the slots to the other.

The present invention is particularly advantageous since it provides a single lift mechanism attached to the truck for lifting and depositing in the side hopper of the truck garbage from a plurality of containers. That is, each container need not have its own lift mechanism in the fashion taught by the art.

In addition, the present invention is advantageous since during the lifting of a container, the container slides so that the rods attached to the container move from one end of the slots in the arms to the other. In so doing, the container is jolted, and the garbage therein is loosened in order to obtain a complete dump from the container.

Other advantages of the present invention include a lower retaining mechanism to prevent the garbage container from flipping away from the cross member lift assembly into the hopper. Also, stabilizing legs are provided to support the weight of the container and its garbage at the long moment arm relative to the center of the truck whereby the truck is prevented from tipping.

These advantages and other objects obtained by this invention are further explained and may be better understood by reference to the drawings and descriptive matter which follow. A preferred embodiment of the invention is illustrated and then described in detail.

BRIEF DESCRIPTION OF THE DRAWINGS

FIG. 1 is a side view of a garbage truck including container lift apparatus in accordance with the present invention;

FIG. 2 is a perspective view of a side hopper with container lift apparatus in accordance with the present invention;

DETAILED DESCRIPTION OF THE PREFERRED EMBODIMENT

Figure 3:
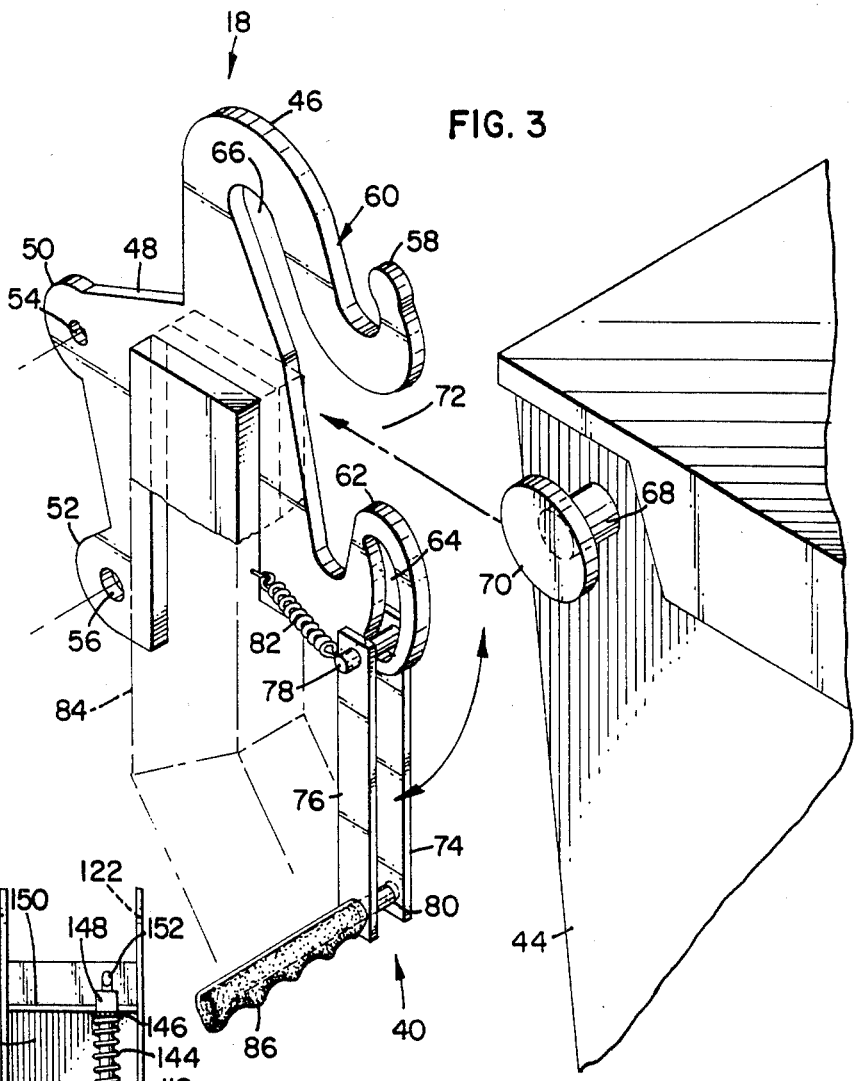
FIG. 3 is a detail in perspective of an arm and lock mechanism in accordance with the present invention.

Referring now to the drawings wherein like reference numerals designate identical or corresponding parts throughout the several views, and more particularly to FIG. 1, container lift apparatus in accordance with the present invention is designated generally by the numeral 10. Apparatus 10 is shown mounted on a garbage truck 12. Side 14 of truck 12 is pivotable downwardly by an hydraulic assembly to form a hopper 16. The hydraulic assembly includes a piston/cylinder assembly 15 and a link 17 attached between pivot 19 on box 23 of truck 10 and pivot 21 on crank arm 25 attached to hopper 16. Hopper 16 includes a sleeve 27 which pivots about rod 29 attached to box 23. The hydraulic assembly is operated to move side 14 between open and closed positions with respect to box 23.

FIG. 2 shows side 14 pivoted downwardly to form hopper 16. A pair of spaced-apart arms 18 are pivotably attached with a nut and bolt combination 20 to brackets 22. Brackets 22 are fastened with a weld or other conventional fastening mechanism to the upper, outermost portion of hopper 16. Near the bottom of hopper 16 brackets 24 are attached by weld or other conventional fastening mechanism and include tabs 26. Hydraulic piston and cylinder assemblies 28 extend between arms 18 and tabs 26, attached to hopper 16 through brackets 24 and tabs 26. Stabilizing legs 30 are attached beneath hopper 16 to brackets 24.

Apparatus 10 further includes a lift assembly 32 attached to arms 18, and holding mechanism 34 having upper retaining mechanism 36 including slot 38 and lock mechanism 40 and also having lower retaining mechanism 42. In more detail, one of arms 18 is shown in FIG. 3 relative to container 44. Arm 18 has a modified scroll C-shape 46 with a thickened body 48 and upper and lower tabs 50 and 52 opposite C-shape portion 46. Tabs 50 and 52 have openings 54 and 56 for attachment to bracket 22 and hydraulic assembly 28, respectively, as indicated hereinbefore. C-shaped portion 46 has an upturned top end 58 to form a hook 60. The lower end 62 of C-portion 46 includes a slot 64. Hook 60 and slot 64 are functional elements of lock mechanism 40 as described hereinafter. The open central portion of C-shaped portion 46 is designated as slot 66 and functions to receive rod 68 attached to an upper side corner of container 44. Rod 68 preferably has a button 70 fastened at its end to prevent it from sliding out of slot 66. Slot 66 is preferably shaped in a large-angle V with an open base 72 between hook 60 and end 62.

Lock mechanism 40 includes inner and outer parallel strips 74 and 76 held by welding or other fastening mechanism in a spaced relationship with lower and upper rods 78 and 80. Strips 74 and 76 are on opposite sides of arm 18. Lower rod 78 passes through slot 64 and extends somewhat beyond outer strip 76. An extension spring 82 is attached between the protruding portion of rod 78 and leg 84 to be described hereinafter. Rod 80 also extends beyond outer strip 76 to receive a grip 86. When container 44 is slid or rolled so that rod 68 is received in slot 66, lock mechanism 40 is closed or locked. Lock mechanism 40 is closed simply by grasping grip 86 and rotating strips 74 and 76 upwardly and pulling rod 78 upwardly in slot 64 until rod 80 between strips 74 and 76 is received by hook 60. Spring 82 is extended by the rotation and the upward positioning so as to tend to keep rod 80 in hook 60. Lock mechanism 40 is unlocked by pulling upwardly on grip 86 to further extend spring 82 until rod 80 may be moved over end 58 of hook 60.

Arm 18, as indicated hereinbefore, is rotatably attached to bracket 22 at opening 54 with nut and bolt combination 20. Hydraulic assembly 28 is pivotably attached with nut and bolt combination 88 (see FIG. 2) at opening 56 of lower tab 52 of arm 18.

Lift assembly 32 is attached to and rotates with arms 18. Lift assembly 32 includes downwardly extending legs 84 and a cross member 90. The upper end portions 92 of legs 84 are welded or otherwise attached to the body portions 48 of arms 18. Legs 84 are angled so that cross member 90 is very close to container 44 when rods 68 of container 44 are received in slots 66 of arms 18. Legs 84 and cross member 90 members quare tubes or other sufficiently strong structural members for lifting container 44 as lift structure 32 rotates with arms 18.

Figure 4:
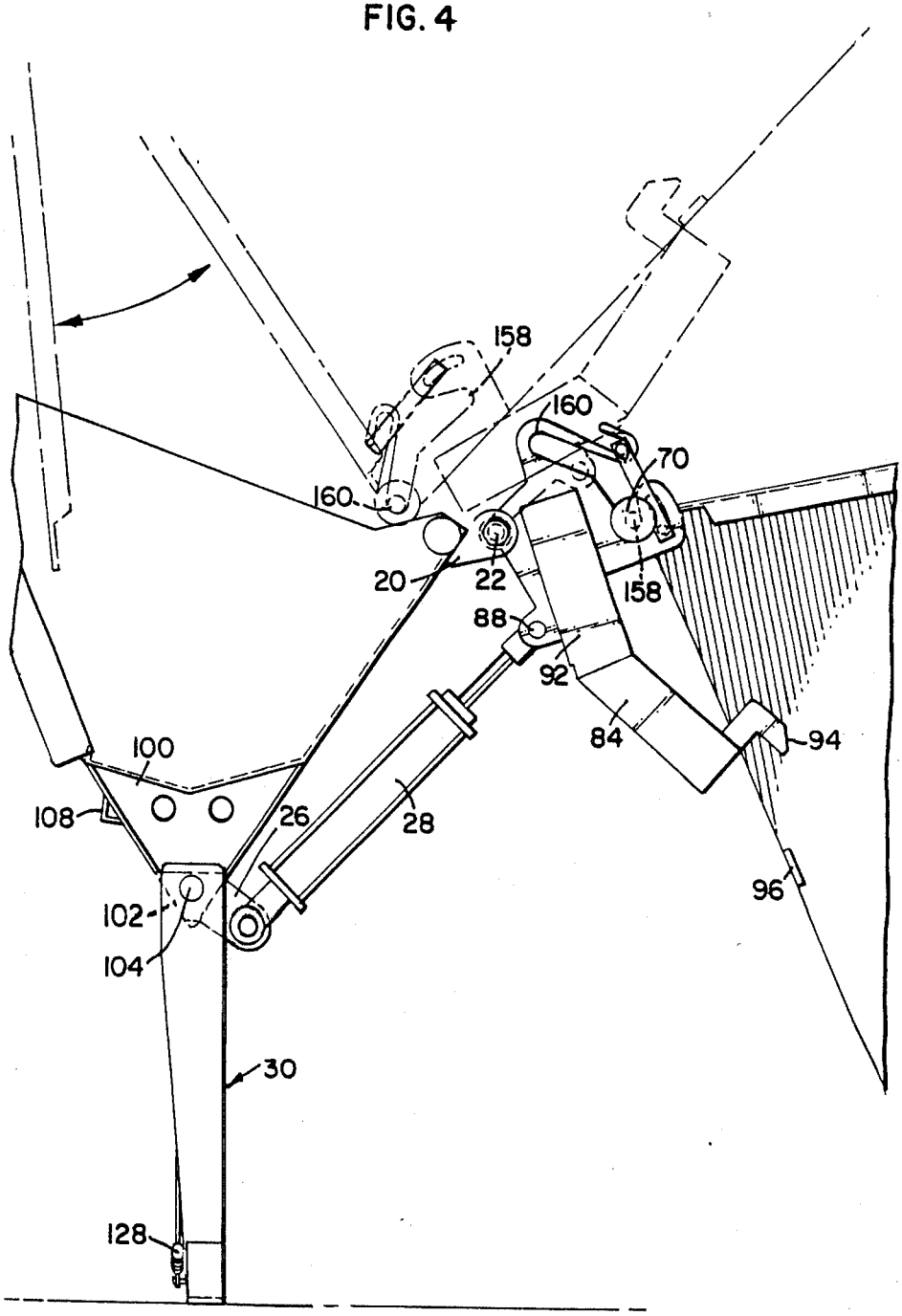
FIG. 4 is a side view of the hopper and apparatus of FIG. 2 showing a container partially lifted in solid lines and fully lifted in phantom lines.
Figure 6:
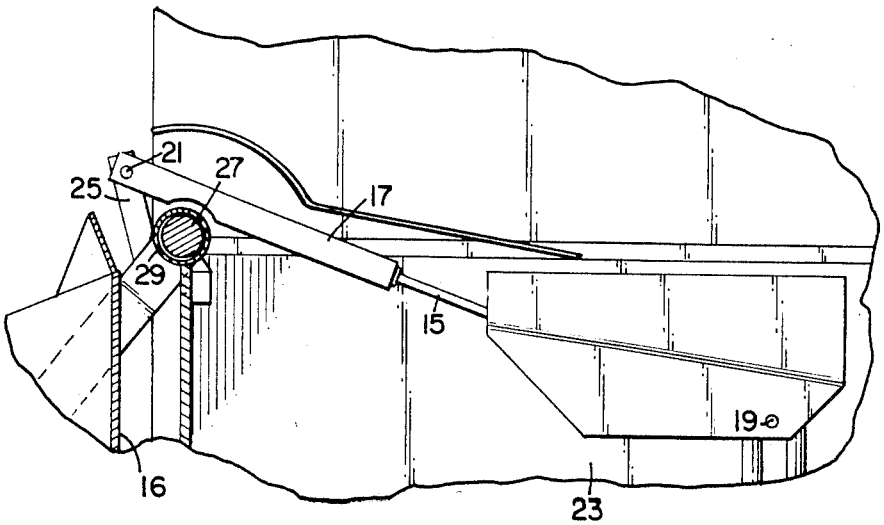
FIG. 6 is a cross-sectional view taken along line 6—6 of FIG. 1.

The lower retaining mechanism 42 is a hook member 94 made from plate or sheet material cut in the form of a right angle and welded near one end of cross member 90. Hook member 94 is located so that it is adjacent to a side wall of container 44 when rods 68 are received in slots 66 of arms 18. Hook member 94 cooperates with a protuberance 96 (see FIG. 4) which is a rectangular plate welded to protrude from the side container 44. When container 44 is positioned for lifting by apparatus 10, hook member 94 is sufficiently above protuberance 96 so that container 44 may be moved toward and away from apparatus 10. When container 44 is lifted and rotated so that rods 68 slide from one end of slot 66 to the other, the relationship of member 94 and protuberance 96 is such that hook member 94 catches or engages protuberance 96 and prevents container 44 from flipping or rotating about rods 68 away from lift assembly 32.

With reference to FIG. 2, one of brackets 24 is hereinafter described as being representative of both and having a substantially triangular shape with its base in contact with and welded or otherwise fastened to the bottom portion of hopper 16. Bracket 24 has reinforcement plates 98 along the downwardly inclined sides of a central main member 100. The lower end of bracket 24 includes a boss 102 (see FIG. 4) with an opening therein for receiving nut and bolt combination 104 for rotatably holding leg 30. As indicated hereinbefore, tab 26 extends outwardly near the bottom portion of bracket 24 and has an opening therein to receive nut and bolt combination 106 for pivotably holding the lower end of hydraulic assembly 28. A catch 108 formed as an angle member and attached by weld or otherwise to an upper rear portion of bracket 24 holds leg 30 in a retracted position as described more fully hereinafter.

Figure 5:
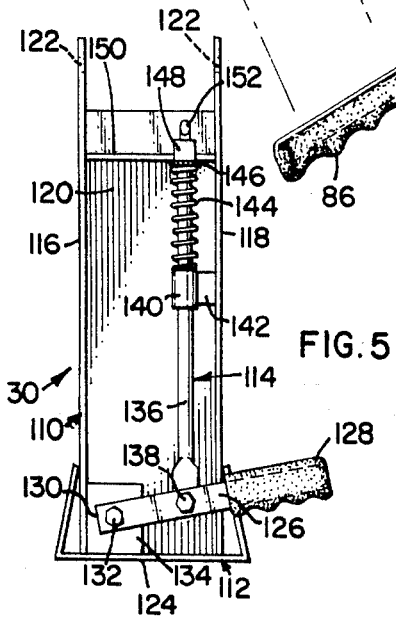
FIG. 5 is a side elevation detail of a stabilizing leg.

As shown in FIG. 5, a leg 30 in the present embodiment includes main leg member 110 with a foot 112 and a retaining mechanism 114. Main member 110 is a sheet or plate bent near the side edges to form a channel-like member. Sides 116 and 118 extend above back 120. In the extended end portions, there are openings 122 for receiving nut and bolt combination 104 to attach leg 30 to bracket 24.

Foot 112 is a plate bent at the side portions to extend upwardly to meet and be fastened by weld or otherwise to sides 116 and 118 of main member 110. The base 124 of foot 112 provides a flat surface for leg 30 so that it does not excessively penetrate the ground.

A retaining mechanism 114 holds a leg 30 in a retracted position when hopper 16 is forming a side 14 of garbage truck 12. Retaining mechanism 114 has a handle 126 with a grip 128 extending adjacent to but beyond side 118 of main member 110. The end 130 of handle 126 opposite grip 128 is attached with nut and bolt combination 132 to a plate 134 welded or otherwise attached to side 116 and base 124 of foot 112. Between grip 128 and nut and bolt combination 132, a rod 136 is attached with nut and bolt combination 138 to handle 126. Rod 136 is held in a substantially vertical position by a pipe section 140 attached by a bracket 142 to main member 116. A spring 144 is compressed between pipe section 140 and a washer 146 held by a second pipe section 148 welded or otherwise attached to the upper end portion of rod 136. Pipe section 148 is guided within a slot (not shown) of bracket 150 welded or otherwise attached between sides 116 and 118 of main member 110. The upper end 152 of rod 136 has a right angle bend so that end 152 extends away from back 120. End 152 preferably is enlarged at the very end so that when end 152 is received within an opening (not shown) in catch 108 (see FIG. 2), it will be retained in combination with the forcing action of spring 144.

As indicated hereinbefore, hydraulic piston and cylinder assemblies 28 extend between tabs 26 on brackets 24 and tabs 52 on arms 18. Assemblies 28 are in fluid communication through a series of hoses, pipes and fittings represented by inlet and outlet lines 154 and 156 in FIG. 1. Lines 154 and 156 are connected in a well known fashion to a source of hydraulic fluid, a pump and a valve, as well as possibly other components, none of which are shown, but, as indicated, all of which are known to those skilled in the art.

In use, garbage truck 12 is stopped so that side 14 faces a garbage container 44. Handles 126 at grips 128 are pulled downwardly to compress springs 144 and remove ends 152 from catches 108 so that legs 30 are free to pivot. Side 14 is then lowered in a conventional fashion to form hopper 16. Legs 30 rotate under the force of gravity to a vertical position to form a stabilizing support for the opposite ends of hopper 16. Lock mechanisms 34 are then both opened. Container 44 is slid against apparatus 10 so that rods 68 are received in slots 66 through openings 72. Strips 74 and 76 are then rotated about pin 78 and lifted upwardly in slot 64 until rod 80 is received in hook 60 to lock slot 66 closed. Hydraulic assemblies 28 are then energized so that the pistons extend thereby rotating arms 18. As shown in solid lines in FIG. 4, rods 68 move to the bottom end of slot 66 and cross member 90 contacts container 44 so that as the pistons extend and arms 18 are rotated further, container 44 is lifted by arms 18 and assembly 32 and rotated about nut and bolt combinations 20. When arms 18 reach a rotational position wherein the lower portions of slots 66 have passed from a downward pointing direction through the horizontal to an upward pointing direction, container 44 slides so that rods 68 move from the lower end 158 of slot 66 to the upper end 160. The sliding movement is rapid and container 44 is stopped by protuberance 96 being caught by hook member 94 and rods 68 reaching the upper ends 160 of slots 66. The shock of stopping causes the lid of container 44 to open and the garbage therein to be shocked free of the side walls and bottom. Further lifting and rotation results in a complete emptying of container 44 into hopper 16. Container 44 is prevented from rotating about rods 68 and leaving cross member 90 of lift assembly 32 by the lower retaining mechanism 42.

When the garbage has been dumped, assemblies 28 are reversed so that pistons retract thereby counterotating arms 18. When container 44 is again on the ground, grips 86 are lifted so that rods 80 may be lifted over ends 58 and disengaged from hooks 60. Container 44 is then slid away from assembly 10. Members 40 may again be locked in place, although they need not be. Hopper 16 is then folded upwardly to form side 14 of the box of truck 12 once again. In this way, the garbage is lifted and compressed into the box of truck 12. Handles 126 are pulled and pushed as appropriate to position end 152 in the opening of catches 108 so that legs 30 are locked against side 14.

As pointed out hereinbefore, the present invention advantageously provides a single lift mechanism for a side loading garbage truck to lift and dump a plurality of containers into the open side hopper so that the garbage may be moved and compressed in the box of the truck. The present apparatus includes legs for stabilizing the open hopper, and a mechanism for shocking the container as it is being lifted so that the garbage therein is released from sticking to the bottom and sidewalls of the container. The present invention has been described in detail with respect to the preferred embodiment. It is understood, however, that many of the brackets and other components could be formed in a variety of other designs and, consequently, that the present embodiment is illustrative only. For this reason, changes made, especially in matters of shape, size, arrangement and combinations of known components and assemblies, to the full extent extended by the general meaning of the terms in which the appended claims are expressed, are within the principle of the present invention.

What is claimed is:

1. Container lift apparatus for a garbage truck, said truck having a box and means for pivoting a side of said box between open and closed positions, said side in the open position forming a hopper for receiving garbage, said side movable with said pivoting means to the closed position to move said garbage from said hopper to said box, said apparatus comprising:

an arm;

means for pivotably attaching said arm to said hopper;

an hydraulic piston and cylinder assembly having one end attached to said hopper and a second end attached to said arm at a location spaced from the axis of said arm attaching means;

means for controllably energizing said assembly; and means, attached to said arm, for holding said container;

whereby said holding means holds said container as said hydraulic assembly rotates said arm to lift said container and dump garbage from same into said hopper.

2. Apparatus in accordance with claim 1 wherein said holding means includes means for lifting said container as said hydraulic assembly pivots said arm, said lifting means being attached to said arm.

3. Apparatus in accordance with claim 1 wherein said holding means includes means for shocking said container while said container is lifted.

4. Apparatus in accordance with claim 1 including means for stabilizing said hopper as said hydraulic assembly lifts said container.

5. Container lift apparatus for a garbage truck, said truck having a box and means for pivoting a side of said box between open and closed positions, said side in the open position forming a hopper for receiving garbage, said side movable with said pivoting means to the closed position to move the garbage from said hopper to said box, said apparatus comprising:

a pair of spaced-apart arms, said arms having means for holding said container;

means for pivotably attaching said arms to said hopper;

means, attached to said arms, for lifting said containers upon rotation of said arms;

a pair of hydraulic piston and cylinder assemblies each having one end attached to said hopper and a second end attached to one of said arms, said assemblies for powerably rotating said arms thereby lifting said containers;

means for controllably energizing said assemblies; and means for stabilizing said hopper when said assemblies lift said container.

6. Apparatus in accordance with claim 5 wherein said holding means includes upper and lower means for retaining said container during lifting, said upper retaining means including means for guiding said container as said container slides between first and second positions during lifting, whereby said upper means retains said container when said container is in the first position while both said upper and lower means retain said container in the second position, said guiding means guiding said container between the first and second positions.

7. Apparatus in accordance with claim 6 wherein said guiding means includes a slot in each of said arms for receiving a rod attached to said container, whereby said rods slide in said slots between the positions.

8. Apparatus in accordance with claim 7 wherein said upper retaining means includes means for releasably locking said rods in said slots.

9. Apparatus in accordance with claim 8 wherein said lower retaining means includes a hook member for catching a protuberance attached to said container when said container slides from said first position to said second position thereby preventing said container from rotating about said rods and falling away from said lifting means.

10. Apparatus in accordance with claim 6 wherein said lifting means includes a cross member extending between said arms, said cross member being spaced from said upper retaining means, whereby when said arms are rotated, said cross member and said upper retaining means function together to lift said container.

11. Apparatus in accordance with claim 10 wherein said lower retaining means includes a hook member attached to said cross member for catching a protuberance attached to said container when said container slides from said first position to said second position thereby preventing said container from rotating about said rods and fall away from said lifting means.

12. Container lift apparatus for a garbage truck, said truck having a box and means for pivoting a side of said box between open and closed positions, said side in the open position forming a hopper for receiving garbage, said side movable with said pivoting means to the closed position to move the garbage from said hopper to said box, said apparatus comprising:

a pair of spaced-apart arms pivotably attached to said hopper, said arms each having a slot spaced approximately the same distance from the pivotal axis of said arm, said slots for receiving rod members attached to the container;

means, attached to said arms, for locking the rods of the container in said slots;

a cross member attached to and extending between said arms for lifting the container on rotation of said arms, said cross member being spaced from said slots, said cross member and said slots lifting the container on rotation of said arms;

a hook member attached to said cross member, said hook member for catching a protuberance attached to said container when said container slides so that the rods attached thereto move from one end of said slots to the other whereby said hook member prevents said container from falling away from said cross member;

a pair of hydraulic piston and cylinder assemblies each having one end attached to said hopper and a second end attached to one of said arms at a location spaced from the axis of said arms, said assemblies for powerably rotating said arms thereby lifting said containers;

means for controllably energizing said assemblies; and a pair of spaced-apart legs for stabilizing the hopper of said garbage truck when said assemblies lift the garbage container.

* * * * *